United States Patent [19]

Locker

[11] Patent Number: 4,679,495

[45] Date of Patent: Jul. 14, 1987

[54] AIR DIFFUSER

[76] Inventor: Howard W. Locker, 820 N. Ocean Blvd., Delray Beach, Fla. 33444

[21] Appl. No.: 259,667

[22] Filed: May 1, 1981

Related U.S. Application Data

[63] Continuation of Ser. No. 17,412, Mar. 5, 1979, abandoned, which is a continuation-in-part of Ser. No. 817,222, Jul. 20, 1977, Pat. No. 4,142,456.

[51] Int. Cl.[4] ..... F24F 7/00

[52] U.S. Cl. ..... 98/40.12; 98/40.01

[58] Field of Search ..... 98/40 D, 40 R, 40 V, 98/39, 33 R, 38, 40.01, 40.05, 40.12

[56] References Cited

U.S. PATENT DOCUMENTS 3,703,141 11/1972 Pernoud ..... 98/40 D 3,760,708 9/1973 Burup ..... 98/40 D

*Primary Examiner*—Henry A. Bennet

*Attorney, Agent, or Firm*—Gifford, Groh, VanOphem, Sheridan, Sprinkle and Dolgorukov

[57] ABSTRACT

An air diffuser for a ceiling or wall conditioned air outlet. The diffuser has a plurality of nozzles separating the flow of air from the outlet to the ambient into a plurality of diverging air jet streams, with the result that air flowing from the outlet is diffused and substantially uniformly distributed throughout an enclosure, without causing uncomfortable drafts.

8 Claims, 17 Drawing Figures

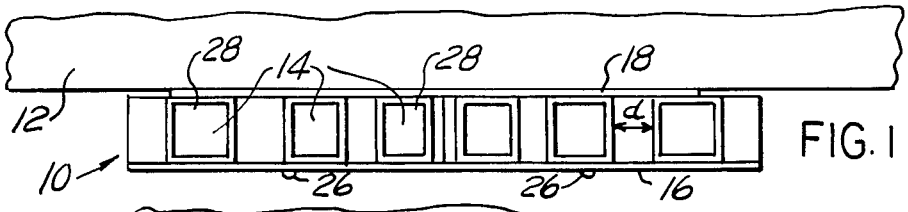
FIG. 1
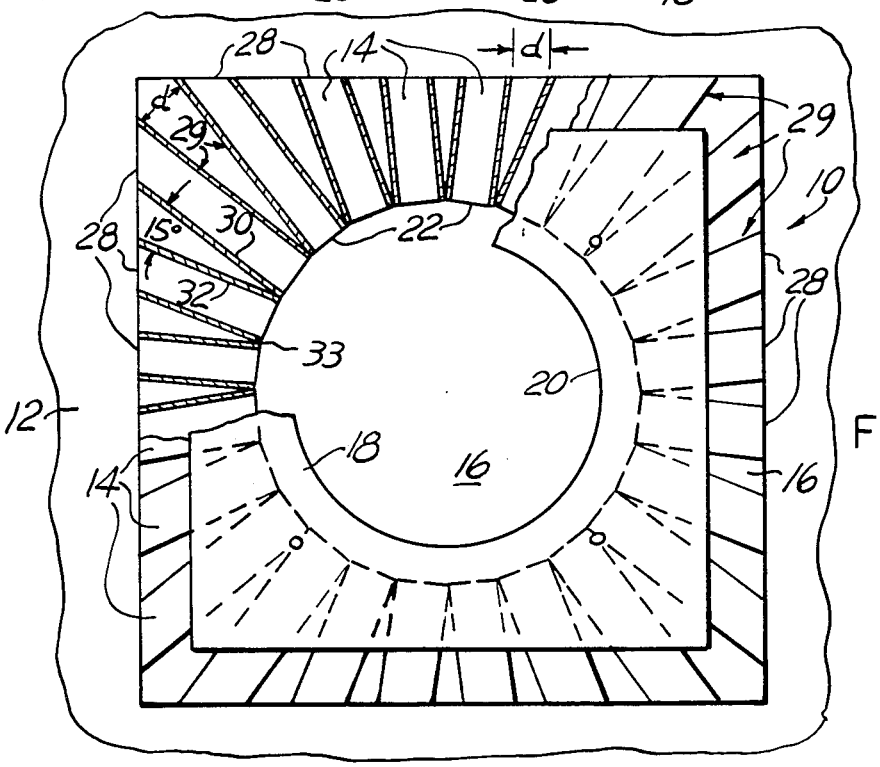
FIG. 2
FIG. 3
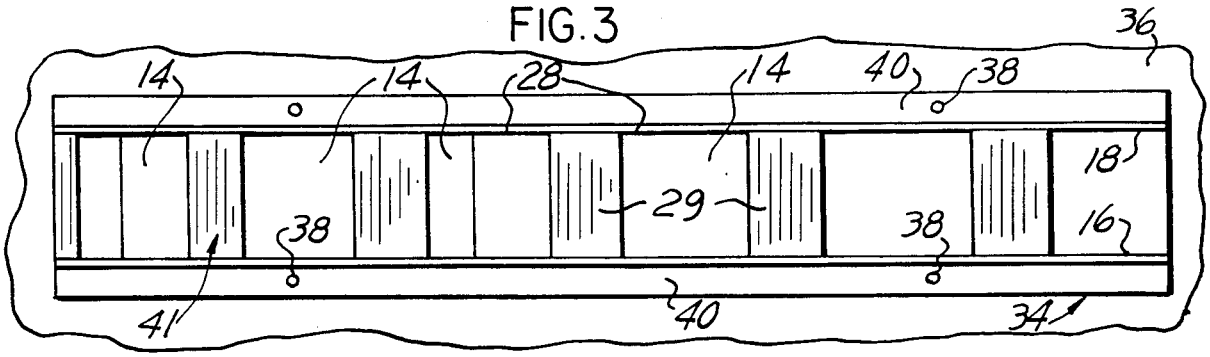
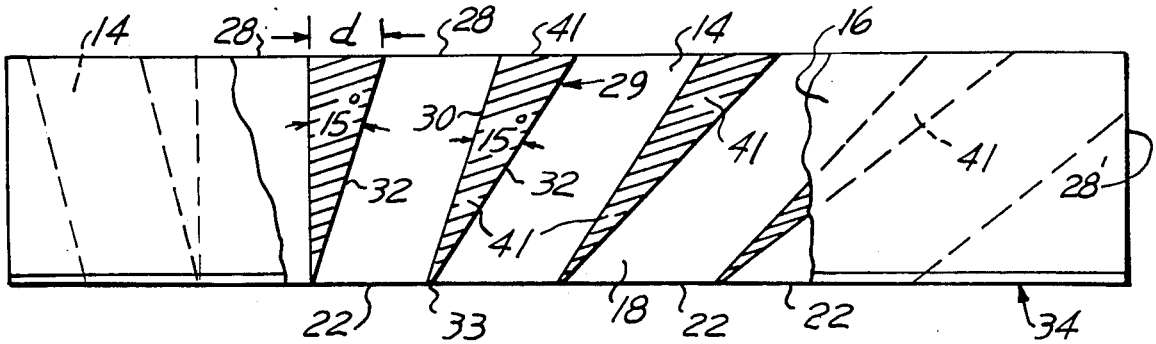
FIG. 4

FIG.5
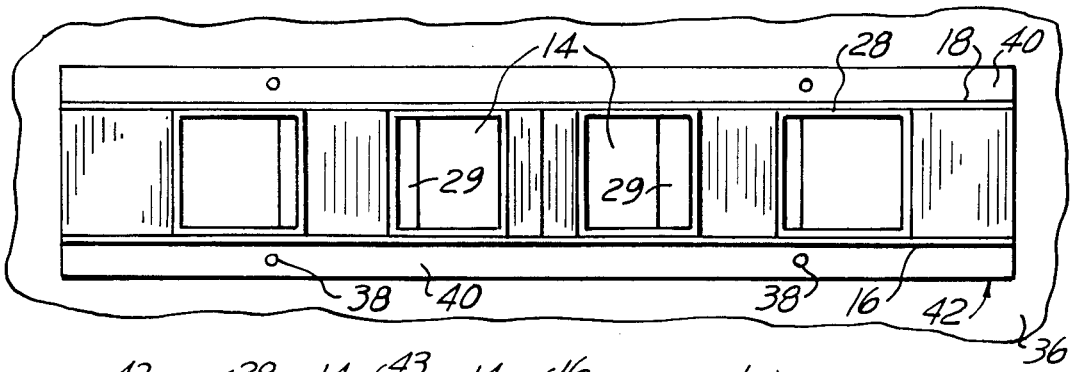
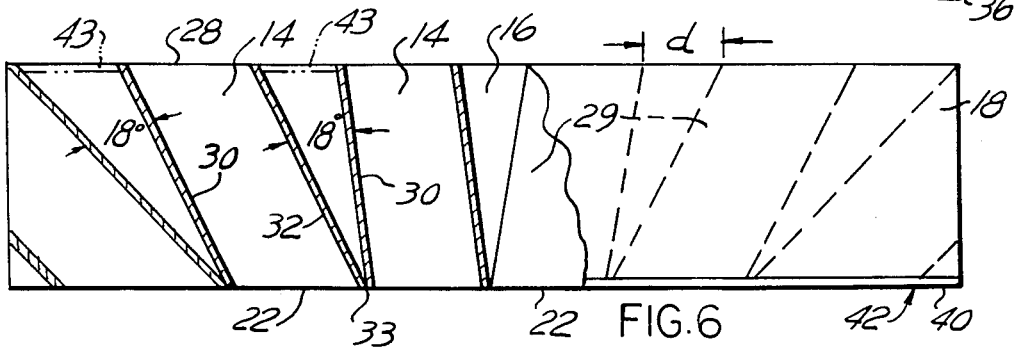
FIG.6
FIG. 7
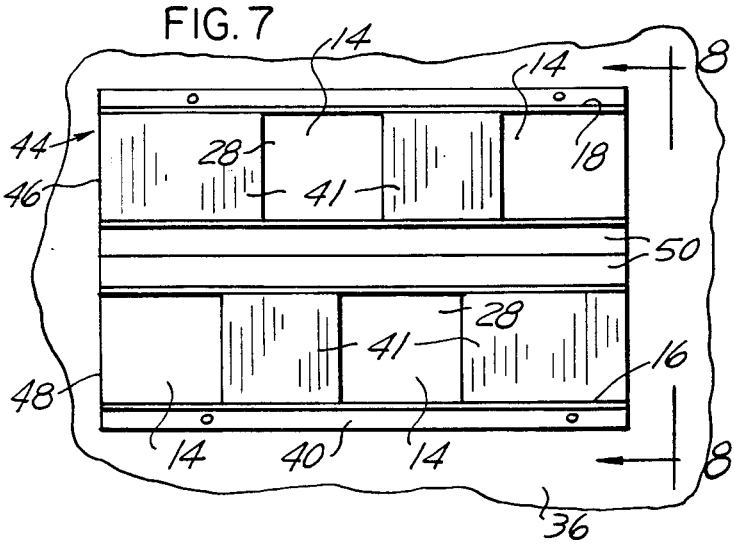
FIG.8
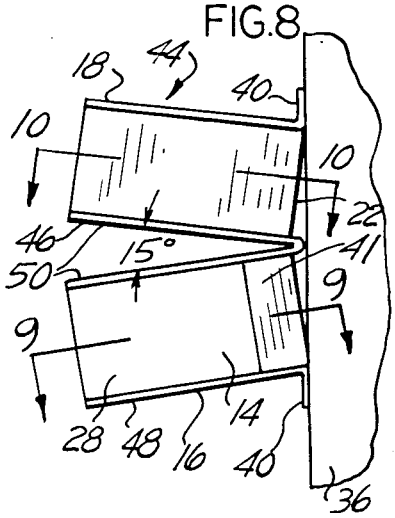
FIG.9
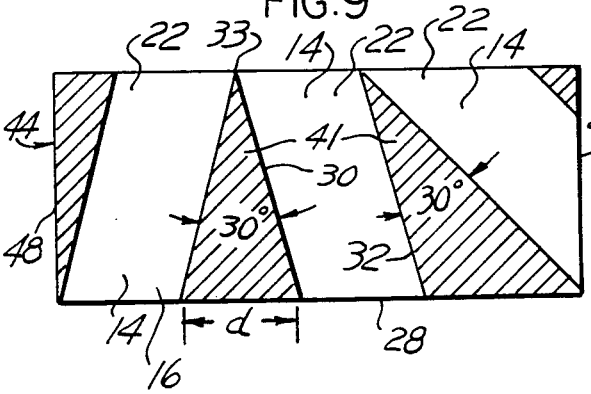
FIG. 10
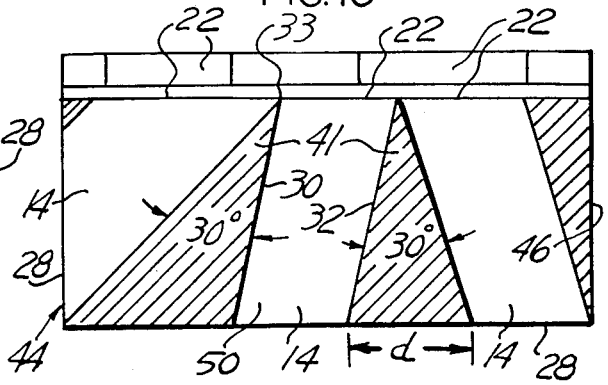

AIR DIFFUSER

CROSS-REFERENCE TO RELATED APPLICATIONS

This is a continuation of application Ser. No. 017,412, filed Mar. 5, 1979, now abandoned, which was a continuation-in-part of application Ser. No. 817, 222 filed July 20, 1977, now U.S. Pat. No. 4,142,456 issued Mar. 6, 1979.

BACKGROUND OF THE INVENTION

Conditioned air, either heated air, cooled air, dehumidified air, humidified air, or mixtures thereof, is distributed into diverse enclosed spaces within a building by means of appropriate ducts leading into appropriate ceiling outlets or wall outlets. Diverse types of diffusers have been designed in the past, some provided with dampers and with fins that may be individually adjustable, for attempting to provide effective distribution of the conditioned air according to the particular conditions prevalent in the enclosed spaces.

A particular disadvantage of the types of air diffusers heretofore available is that they are generally incapable of providing even distribution of conditioned air through the enclosed space, without creating drafts and uneven distribution of the conditioned air, with the result that, more particularly with respect to cooled conditioned air, uncomfortable blasts of cold air are prevalent in some areas of the enclosed space, while other areas remain uncomfortably warm.

The present invention remedies the inconveniences of the prior art by providing air diffusers for ceiling outlets as well as for wall outlets which are particularly effective in preventing direct flow of air into the enclosed space, which are particularly effective in slowing down the flow of air in distributing the conditioned air evenly throughout the space, and in mixing the conditioned air thoroughly with the secondary air, or air already present in the space.

The diffusers of the present invention present particular advantages where it is desirable to cool the air supplied to an enclosed space. By separating the flow of cooled air into separate individual streams or jets, the invention permits mixing of the room air, or secondary air, with the cooled air without causing drafts or uncomfortable wide heat gradients. As the incoming cool air is thoroughly mixed with the secondary air, better control of the temperature within the enclosure is provided, and the location of the return air openings is no longer critical. Smooth and even air circulation and ventilation are provided, without stratification or separation between cold and warm air, and there is no longer any requirement to re-heat cooled air before distributing to a confined space to avoid ingress into the space of contrasting low temperature air currents. The air diffuser of the present invention thus promotes considerable savings in energy.

SUMMARY OF THE INVENTION

The several objects and advantages of the present invention are accomplished by providing a diffuser structure for ceiling outlets and for wall outlets which separates the incoming air into a plurality of separate radial jets which thoroughly mix the secondary air in an enclosure with the conditioned air of the jets. The invention accomplishes its purposes by providing a diffuser wherein the incoming air is separated in the radial jets by way of fixed wedge-shaped fins defining separate diverging nozzles substantially square, in section, for dividing the flow of air in such a plurality of radial jets.

The many objects and advantages of the present invention will become more apparent to those skilled in the art when the following description of some of the best modes contemplated for practicing the invention is read in conjunction with the accompanying drawing wherein like numerals refer to like parts and in which:

BRIEF DESCRIPTION OF THE DRAWING

FIG. 1 is a front elevation view of a ceiling type air diffuser according to the present invention;

FIG. 2 is a top elevation view of the air diffuser of FIG. 1, with portion cut away to show the internal construction;

FIG. 3 is a front elevation view of an example of structure of wall air diffuser according to the present invention;

FIG. 4 is a top plan view thereof with portions cut away to show the internal structure;

FIG. 5 is a front elevation view similar to FIG. 3 but showing a modification thereof;

FIG. 6 is a top plan view thereof with portions cut away to show the internal structure;

FIG. 7 is a front elevation view of another example of structure for a wall air diffuser according to the present invention;

FIG. 8 is a side elevation view thereof;

FIG. 9 is a section thereof as seen from line 9—9 of FIG. 8;

FIG. 10 is a section therethrough as seen from line 10—10 of FIG. 8;

DETAILED DESCRIPTION OF THE PREFERRED EMBODIMENTS

Figure 14:
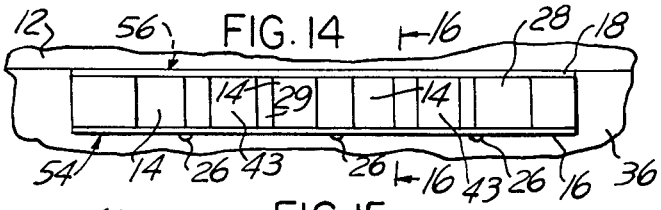
FIG. 14 is a front elevation view of a further example of structure for a ceiling air diffuser according to the present invention.

Referring now to the drawings and more particularly to FIGS. 1–2, an air diffuser 10 according to the present invention, and adapted for placing over an air outlet, not shown, in a ceiling 12, comprises a plurality of nozzles 14 disposed mutually diverging relative to one another between an upper baffle plate 18 and a lower baffle plate 16. The upper baffle plate 18 is provided with a relatively large inlet aperture 20 allowing admission of conditioned air, either cooled or heated air, from the air outlet in the ceiling 12 to the inlets 22 of the plurality of nozzles 14. Appropriate mounting holes 24 are disposed aligned in the lower baffle plate 16 and the upper baffle plate 18 to offer passage to mounting screws or bolts 26.

As illustrated at FIG. 2, the periphery of the air diffuser 10 is substantially square or rectangular in plane projection, or, in other words, the outlets 28 of the nozzles 14 are disposed along the four sides of a square or rectangular perimeter, and are disposed substantially co-planar in the plane of each side. The inlets 22 are disposed about a circular arc, and each nozzle 14 has a constant width and a constant height from inlet 22 to outlet 28 with the result that the nozzles have a substantially square cross-section. The longitudinal axis of each nozzle 14 is disposed at an angle of about 15° relative to the longitudinal axis of the next consecutive nozzle.

In the structures illustrated at FIGS. 1–2, the nozzles 14 are made of tubular metallic ducts 29, or plastic ducts, having a substantially square cross-section, which are disposed between the upper and lower baffle plates 18 and 16, which are also preferably each made of a metallic thin plate or of a plastic sheet cut to the appropriate dimension and shape. The nozzles 14 are sandwiched between the two baffle plates 16 and 18 and are joined to the inner surface of the baffle plates by any convenient means such as cementing, soldering or welding. Adjoining side walls 30 and 32 of consecutive ducts 29 are disposed at a 15° angle at their converging ends which form a sharp leading edge 33. Alternatively, the nozzles 14 may be formed directly between the two baffle plates 16 and 18 as a result of placing wedge members having a leading edge angle of about 15° disposed on a circle defining the circle of the inlets 22, the diverging walls of the wedge members defining respectively one of the side walls 30 and the other side wall 32 of consecutive nozzles 14, substantially as the arrangements described in detail hereinafter and shown at FIGS. 3–4, 7–10 and 11–13.

Although the outlets 28 of the nozzles 14 may be disposed about a square or rectangle, as illustrated at FIGS. 1–2, or about a circle, as disclosed in co-pending application Ser. No. 817,222, or about a perimeter of any appropriate shape such as an oval, an elipse, a heart shape, and the like, for decorative purposes, it has been discovered that, for the purpose of providing a plurality of even and most efficient diverging radial jets of conditioned air out of the nozzles 14, the nozzle inlets 22 are preferably disposed about a circle, the axis of the diverging nozzles are disposed at a mutual angle of not less than 15°, and preferably of not more than about 30°, the average length of each nozzle is at least 1.55 that of its width, or height as the nozzles are preferably square in cross-section, and the space between consecutive nozzles 14, or distance d as shown in FIGS. 1 and 2, is at least one-half the width of the nozzle, for best efficiency of mixing conditioned air with the ambient air in the room or enclosure.

An air diffuser 10 mounted over a ceiling air outlet, made according to the structure illustrated at FIGS. 1–2 and preferably conforming to the preceding parameters, forms an enclosed air radial flow-producing chamber which provides a most efficient arrangement for deflecting and evenly distributing air through the nozzles 14 having their outlets 28 disposed about the periphery of the diffuser. As a result of forming the diverging nozzles 14 with oppositely parallel walls, the air streams, or air jets, through the nozzles 18 are in the form of separate radial jets diverging from each other at an angle of about 15°. Such an arrangement is particularly efficient in entraining secondary air, that is air already contained in a room or enclosure provided with the diffuser 10 of the invention, and is particularly adapted to thoroughly mix the cooled, or heated, air from the jets with the secondary air. It has been observed that four to six parts of secondary air becomes thoroughly mixed with one part of cooled air, for example, flowing through each nozzle 14, with the result that the enclosure is thoroughly conditioned without drafts and without direct flow of cooled air impinging upon the occupants of the enclosure.

FIGS. 3–4 illustrate an example of application of the principle of the invention to a wall diffuser 34 mounted over a rectangular air duct outlet through a wall 36, by means of mounting screws passing through mounting holes 38 in the diffuser mounting flange 40. The air diffuser 34 is designed for mounting over an air outlet, not shown, disposed to one side of the vertical center of a wall, and is provided with a plurality of diverging individual nozzles 14, six in number in the example illustrated, each one substantially square in cross-section and having substantially parallel opposite side walls 30 and 32, and each one having its longitudinal axis disposed at about 15° from the longitudinal axis of the next adjoining nozzle, such that, consequently, the consecutive walls 30 and 32 of consecutive nozzles 14 form a 15° angle at their leading edge 33 at the inlet 22 of the nozzles. The inlets 22 of the nozzles 14 are disposed along a single plane, and the outlets 28 are also disposed along a single plane, with the exception of the extreme right nozzle 14 which has its outlet 28' disposed in a plane perpendicular to the plane of the outlets 28 of the other nozzles. The nozzle 14 are formed by a plurality of wedge members 41 disposed between a lower baffle plate 16 and an upper baffle plate 18, each bent over substantially at 90° at one edge to form the diffuser mounting flange. In the structure of FIGS. 3–4, in addition to each nozzle 14 having a substantially square cross-section and being disposed with its longitudinal axis at about 15° from the longitudinal axis of the next preceding and the next following nozzle, the other critical parameters of the average length of each nozzle 14 being at least 1.55 to width or height, and of the distance d separating the outlets 28 of consecutive nozzle 14 being at least one-half the width or height of the nozzle are also respected for best efficiency, and for providing diverging separate air jets forming best entrainment for secondary air and mixture of the conditioned air flowing from the nozzles 14 with the secondary air present in the enclosure or room.

FIGS. 5–6 represent another example of wall diffuser 42 wherein, because of the existing dimension of the outlet of the rectangular air duct, not shown, in the wall 36, and for the purpose of providing a symmetrical coverage of the diverging air jets over a room or enclosure, the wall diffuser 42 being disposed substantially at equal distances between side walls, the individual air nozzles 14, of substantially square cross-section, are disposed with their longitudinal axis forming an angle of slightly more than 15°, namely 18°. Such an amount of divergence between consecutive nozzles, as long as all the other conditions hereinbefore enumerated are respected, does not reduce appreciably the efficiency of the air flow, and the rate of mixing with the secondary air present in the room or enclosure. The nozzles 14 are made of lengths or ducts 29, square in cross-section, mounted between a lower baffle plate 16 and an upper baffle plate 18. The space between diverging lengths of duct 29 may be left open, as illustrated, or closed by a plate 43 as shown in dotted lines at FIG. 6.

Referring now to FIGS. 7–10, there is illustrated a wall air diffuser 44 for placing over a substantially rectangular wall outlet, the outlet having a relatively substantial height. In order to cover the full height of the air outlet in the wall, the diffuser 44 is provided with two superimposed diverging rows 46 and 48 of diverging nozzles 14. The lower row 48 of nozzles 14 is disposed such as to direct diverging air jets in a slightly downward direction while the upper row 44 has its nozzles 14 directed at a slight angle towards the ceiling of the room or enclosure. It has been found that the best angle of divergence between the upper row 46 of nozzle 14 and the lower row 48 is about at least 15°, and it has been further found that the individual nozzles 14 in each row may have their longitudinal axis diverging as much as 30° from each other, as long as the other parameters of substantial squareness of the cross-section of the nozzles 14 and of the hereinbefore mentioned relationship between the average length and width of the nozzles, and the distance d separating the outlets 28 of the nozzle 14, are respected. In the structure of FIGS. 7–10, the nozzles 14 in the upper row 46 are staggered relative to the nozzles 14 in the lower row 48.

Figure 11:
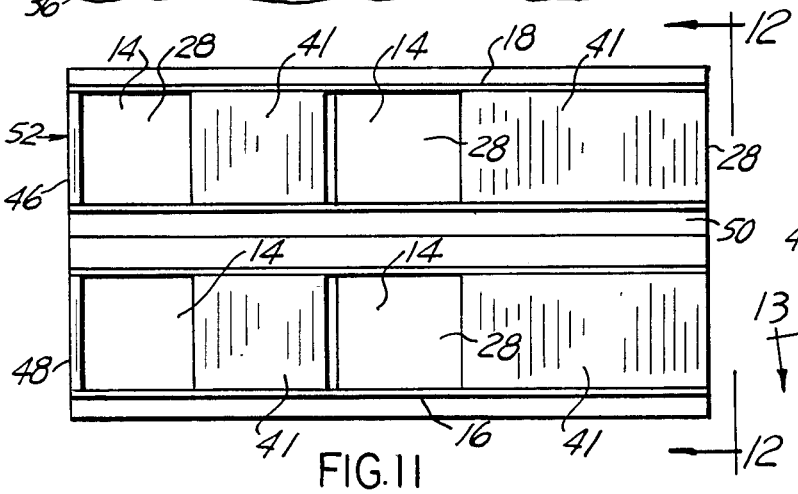
FIG. 11 is a front elevation view of a further example of structure for a wall air diffuser according to the present invention.
Figure 12:
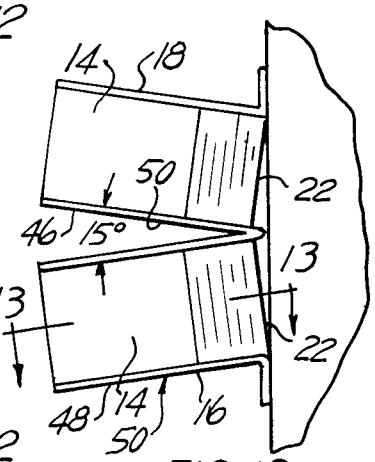
FIG. 12 is a side elevation view thereof.
Figure 13:
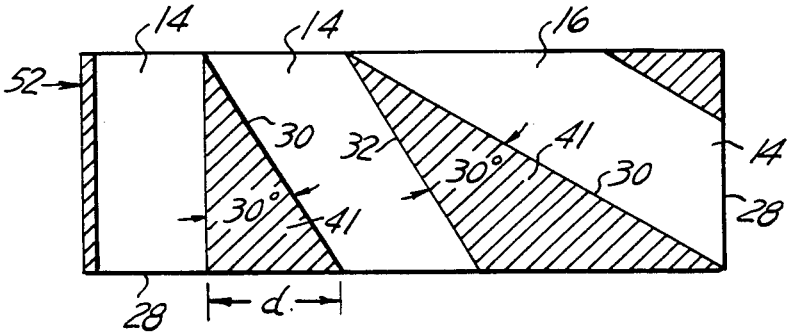
FIG. 13 is a section thereof as seen from line 13—13 of FIG. 12.

FIGS. 11–13 illustrate another example of wall diffuser 52 according to the present invention, similar to the double row wall diffuser 44 of FIGS. 7–10, with the exception of the nozzles 14 in the upper row 46 being vertically aligned relative to the nozzles 14 in the lower row 48.

In the structures illustrated at FIGS. 7–10 and 11–13, the nozzles 14 are formed by wedge members or blocks 41 sandwiched between upper baffle plate 18 and the first of a pair of intermediary rearward converging plates 50 to define the upper row 46 of nozzles 14, and between the second of the intermediary plates 50 and a lower baffle plate 16 to form the lower row 48 of nozzles 14.

It will be readily appreciated that the air diffusers of the invention, and more particularly the structures of FIGS. 3–13, are particularly well adapted for incorporation as an air diffuser for small room air conditioners and heaters, for humidifiers, and the like, and that the structure described and illustrated is particularly suitable as a replacement diffuser for already installed units.

Figure 16:
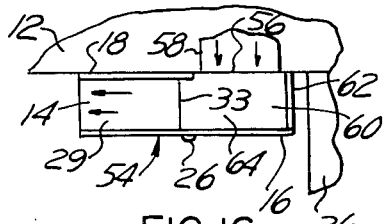
FIG. 16 is a section thereof as seen from line 16—16 of FIG. 14.
Figure 15:
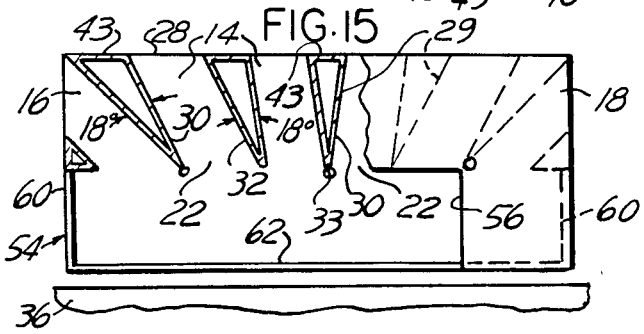
FIG. 15 is a top plan view thereof with portions cut away to show the internal structure.

The structures of FIGS. 3–4 and 5–6 are also particularly suitable for mounting over a ceiling outlet which is located proximate a side wall of a room or enclosure, for mounting over a wall outlet disposed proximate the floor of a room or enclosure, or over the outlet of a casement air conditioner or heater or through a wall air conditioner or heater disposed proximate the floor of a room or enclosure. An example of such a ceiling air diffuser 54, for mounting on a ceiling 12 proximate the side wall 36 of a room or enclosure is illustrated at FIGS. 14–16. The air diffuser 54 comprises an upper baffle plate 18 provided with an aperture 56 disposed over the opening of an air outlet 58 in the ceiling 14 which is disposed proximate a wall 36. The lower baffle plate 16 extends rearwardly such as to provide with side walls 60 and rear wall 62 an air flow containing and directing manifold chamber 64, FIG. 16, directing the flow of air from the outlet 56 of the ceiling duct 58 to the inlet 22 of a plurality of diverging nozzles 14 formed by a plurality of wedge members 29 disposed between the upper baffle plate 18 and the lower baffle plate 16. Although the wedge members 29 are of the type formed by a pair of side walls 30 and 32 disposed at an angle between 15° and 30°, 18° in the example illustrated, provided with a front closure wall 43, it will be appreciated that the wedge members may consist of solid wedge member as previously explained.

Figure 17:
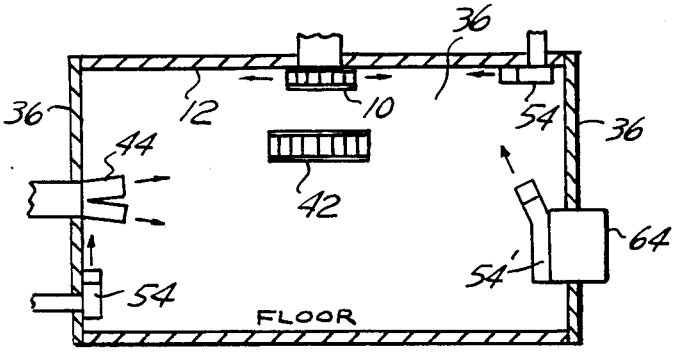
FIG. 17 is a schematic view of a room or enclosure showing for illustrative purpose several air diffusers according to the invention in use at different locations in the ceiling and walls of the room.

FIG. 17 shows schematically, and for illustrative purpose only, a hypothetical room having air outlets leading into the room at diverse locations, each air outlet being provided with an air diffuser according to the present invention. It will be appreciated that it would be uncommon to have in a single room all the air diffusers illustrated and that typically one or two of such air diffusers would be present in a conventional room or enclosure.

FIG. 17 shows two examples of air diffusers 54 of FIGS. 14–16 mounted one over an air duct outlet disposed through a side wall proximate the floor of the room and another air duct 54 mounted over a ceiling air outlet proximate a side wall 36. FIG. 17 also illustrates a modified air duct 54' substantially alike the air ducts 54 but provided with nozzle outlets disposed at an angle to direct diverging air streams toward the ceiling 12 of the room and away from the side wall 36. The diffuser 54', for illustrative purpose, is shown mounted over the air outlet of a through-the-wall or window air conditioner 64. At FIG. 17 is further illustrated the wall outlet air diffuser 44 mounted approximately half-way between the ceiling and the floor of the room, which illustrates an example of the air diffuser 44 of FIGS. 7–10, and an example of use of an air diffuser 42 for a wall substantially like the air diffuser 42 of FIGS. 5–6. A ceiling air diffuser 10 is mounted over a ceiling air outlet disposed substantially at the center of the ceiling, to illustrate an example of use of the air diffuser 10 of FIGS. 1–3.

The air diffusers of the present invention, in actual installation in a room or enclosure, have their diverging nozzles mounted in one or more rows which are directed generally toward the ceiling of the room or enclosure when mounted over outlets disposed proximate the floor, with diverging nozzles directed generally horizontally when mounted proximate the ceiling and with their nozzles directed at an angle toward the ceiling when mounted between such extreme positions. It has been discovered that it is best for efficient mixing of the air jets from the nozzles with the secondary air contained in the room or enclosure that each air jet be enabled to flow unimpeded, that is without hitting any obstacle, for approximately 2.5 meters, about eight feet.

Having thus described the present invention by way of examples of structural embodiments thereof, modifications whereof will be apparent to those skilled in the art, what is claimed as new is as follows:

1. An air diffuser for an air outlet, said air diffuser comprising a plurality of regularly disposed stationary rigid diverging nozzles dividing the flow of air from said outlet into separate diverging air streams, said nozzles each having substantially parallel opposite stationary sidewalls and being substantially square in section, and said nozzles having longitudinal axes mutually disposed at a predetermined constant angle in the range of about 15° to 30°, wherein said nozzles are formed by a pair of substantially parallel flat baffle plates and by a plurality of stationary wedge members disposed between said baffle plates, each of said wedge members has a leading edge formed by a pair of flat walls converging at said predetermined constant angle in the range of about 15° to 30° and is arranged such that opposite walls of consecutive wedge members are substantially parallel and form with said baffle plates said nozzles having substantially square cross-section, and each of said nozzles has an outlet separated from the outlet of an adjacent nozzle by a distance which is at least one-half the width of each of said nozzles.

2. An air diffuser for an air outlet, said air diffuser comprising a plurality of regularly disposed stationary rigid diverging nozzles dividing the flow of air from said outlet into separate diverging air streams, each of said nozzles having substantially parallel opposite stationary sidewalls and being substantially square in section, and said nozzles having longitudinal axes mutually disposed at a constant predetermined diverging angle in the range of about 15° to 30°, wherein said nozzles are each made of a length of square tubular duct and have their longitudinal axes mutually disposed at said constant predetermined angle in the range of about 15° to 30°, adjoining sidewalls of adjacent nozzles converge at a sharp leading edge and intersect at said constant predetermined angle, and each of said nozzles has an outlet separated from the outlet of an adjacent nozzle by a distance which is at least one-half the width of each of said nozzles and a length which is at least 1.55 said width.

3. The air diffuser of claim 1 wherein said nozzles each have a length which is at least 1.55 the width thereof.

4. The air diffuser of claim 1 wherein the inlets of said nozzles are disposed about an arc of a circle.

5. The air diffuser of claim 1 wherein said nozzles have inlets disposed along a single plane.

6. The air diffuser of claim 1 wherein said nozzles are disposed in at least two superimposed rows, each of said rows making at least an angle of about 15° with the other row, and each nozzle in each row having a longitudinal axis disposed at at least about 15° relative to the longitudinal axis of the next consecutive nozzle in said row.

7. The air diffuser of claim 2 wherein the inlets of said nozzles are disposed about an arc of a circle.

8. The air diffuser of claim 2 wherein said nozzles have inlets disposed along a single plane.

* * * * *